United States Patent [19]

Carlsen

[11] 4,266,496

[45] May 12, 1981

[54] STABILIZER MEANS FOR A SURFACE VESSEL

[75] Inventor: Ove Carlsen, Stabekk, Norway

[73] Assignee: A/S Blehr & Tenvig, Oslo, Norway

[21] Appl. No.: 121,958

[22] Filed: Feb. 15, 1980

Related U.S. Application Data

[63] Continuation of Ser. No. 877,643, Feb. 14, 1978, abandoned.

[30] Foreign Application Priority Data

Feb. 23, 1977 [NO] Norway ..... 770610
Nov. 1, 1977 [NO] Norway ..... 773739

[51] Int. Cl.[3] ..... B63B 39/06
[52] U.S. Cl. ..... 114/126; 114/264
[58] Field of Search ..... 114/121, 122, 126, 264, 114/265, 284

[56] References Cited

U.S. PATENT DOCUMENTS

| | | | |
|---|---|---|---|
| 3,176,644 | 4/1965 | Thomas et al. | 114/126 |
| 3,397,545 | 8/1968 | Leavitt | 114/126 |
| 4,041,885 | 8/1977 | Garcia | 114/126 |

FOREIGN PATENT DOCUMENTS

| | | | |
|---|---|---|---|
| 798639 | 11/1968 | Canada | 114/126 |

*Primary Examiner*—Charles E. Frankfort
*Attorney, Agent, or Firm*—Ladas & Parry

[57] ABSTRACT

Apparatus used to stabilize a sea-going surface vessel against pitching, heaving and rolling by means of stabilizer bodies which the vessel carries beneath it. A forward stabilizer body has a horizontal surface area in the range of from 13% to 20% of the ship's waterline plane, with its center of gravity at a distance in the range of from 0.22 L and forward relative to L/2, where L is the length between the perpendiculars. An aft stabilizer body has an area in the range of from 7% to 15% of the ship's waterline plane, with its center of gravity at a distance in the range of from 0.14 L and astern relative to L/2.

9 Claims, 9 Drawing Figures

STABILIZER MEANS FOR A SURFACE VESSEL

This application is a continuation of application Ser. No. 877,643 filed Feb. 14, 1978, now abandoned.

The invention relates to a stabilizer means for a surface vessel, said means serving to stabilize the vessel against pitching, heaving and rolling by means of one or more stabilizer bodies which the vessel carries beneath it.

The invention has been developed especially for use with surface vessels used for work in the offshore sector. Successful investigation and production of oil and other mineral resources at and beneath the sea bed depends on the stability of the floating structures or ships which control the operation under varying weather loads. Other operations at sea require a stable platform, or a platform having predictable and controllable movement characteristics.

It is known that one can obtain relatively stable platforms by making the platforms semi-submersible and the same effect can be obtained for a surface vessel, e.g., a ship, by providing it with one or more stabilizer bodies, carried by the vessel and positioned beneath it, preferably a substantial distance directly below the vessel and at sufficient depth that the stabilizer bodies are not subject to substantial influence by the waves at the surface of the sea. Compared to semi-submersible structures, ships have the advantage of a much wider area of application, and their characteristics are also competitive when one can work with closely coincident movement characteristics, both because a ship can be moved quickly and owing to its displacement, cubical capacity, and the normal loading and maintenance routines.

It has now been found that substantially better stabilization results can be obtained for a ship carrying stabilizer bodies beneath it if the stabilizer bodies have a specific area and a specified position relative to the plane of the ship's waterline. This improved stabilization is caused by the effects of phase displacements between the wave forces affecting the hull and the stabilizer bodies, and the effects of the couplings when the ship is pitching or heaving.

For a ship which is to be stabilized in this way, there will usually be a stabilizer body in the stern half and a stabilizer body forward. These bodies are supported on columns or the like and can be raised and lowered, such that they can be retracted and locked in position beneath the bottom of the vessel when they are not in use, for example, when the vessel is to be moved.

The area and the longitudinal positioning of the stabilizer bodies must also be selected in accordance with the operations that the vessel is to perform—where on the ship one wishes the movements and accelerations to be diminished most. Examples of operations where this would be important are crane operations with a crane mounted in the bow, or drilling operations from a midships drilling tower.

According to the invention, therefore, and based on a number of model experiments and comprehensive computer simulations, it has been determined that the horizontal surface area of the forward stabilizer body should be in the range of from 13% to 20% of the ship's waterline plane, with its center of gravity at a distance in the range of from 0.22 L and forward relative to L/2, where L is the length between the perpendiculars. The stabilizer body in the stern should have an area in the range of from 7% to 15% of the ship's waterline plane, with a center of gravity at a distance in the range of from 0.14 L and astern relative to L/2.

As mentioned above, it has been found that these areal dimensions and positionings give very good results. This has a connection with the vessel's displacement and the displacement of the stabilizer bodies which, owing to their shape, restrict large oscillating water masses. The restriction of the oscillating water mass can be increased, moreover, by providing the stabilizer bodies, which are shaped as plates or platforms, with rolling keels on the top and bottom sides. This will significantly increase the lateral plane of the stabilizer bodies and the stabilizer bodies and the oscillating lateral masses of water. The natural frequency of the ship's rolling will increase at the same time as its rolling is reduced.

Especially good results are obtained if the areal center of gravity of the forward stabilizer body lies at a distance in the range of from 0.22 L to 0.42 L forward of L/2, and the areal center of gravity of the stern stabilizer body lies at a distance in the range of from 0.14 L to 0.30 L astern of L/2.

The invention is not restricted to any specific structural shape as far as the suspension of the stabilizer bodies is concerned. However, the stabilizer bodies can advantageously be supported by the vessel in a manner which allows them to be raised and lowered, such that from a transport position up beneath the bottom of the vessel, the body can be lowered into a working position, i.e., a stabilizing position, and the body is then preferably arranged so as to be movable longitudinally on a longitudinal support member carried by the vessel, such that the stabilizer body can be displaced in the longitudinal direction of the vessel.

The invention will be described in further detail with reference to the drawings, where FIG. 1 schematically shows a ship provided with stabilizer platforms beneath the vessel, the platforms being dimensioned and positioned in accordance with the invention.

Figure 1:
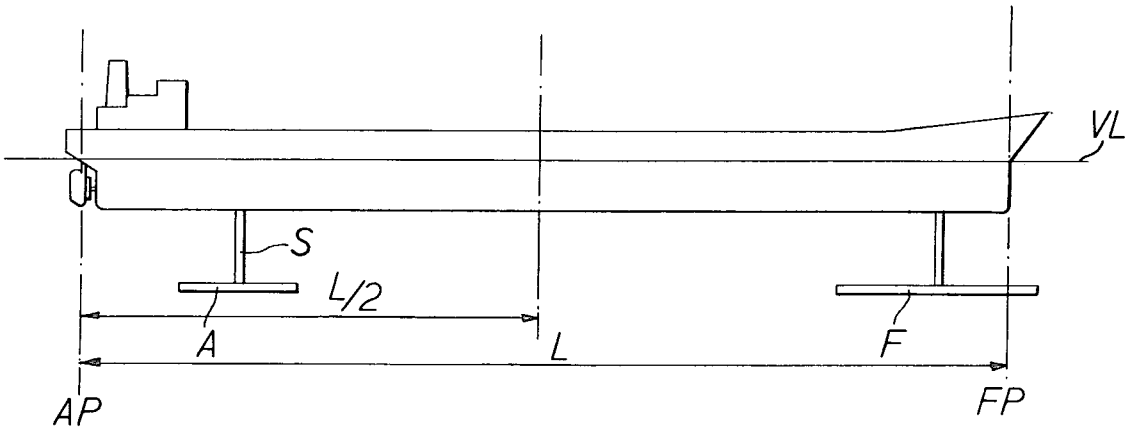

The ship's perpendiculars are designated AP and FP (aft and forward perpendiculars, respectively), and the length between the perpendiculars is designated L. The waterline is designated VL.

The aft stabilizer platform A and the forward stabilizer platform F are shaped and positioned such that their centers of gravity are within the limits given above. Referring to the drawing, one can for the sake of simplicity assume that the center of gravity lies on the axis of the support column S for the stabilizer platform. One or more support columns can of course be used.

The shape of the stabilizer platforms in horizontal projection, i.e., their contours, can be adapted to the pertinent conditions for the vessel in question, and the stabilizer platforms will preferably have a rectangular shape, while the shape of the aft platform can also be adapted to follow the lines of the stern half of the ship, such that the co-current distribution at full speed is acceptable. The stabilizer platforms should be able to be raised and lowered, and especially with respect to the forward platform, also be displaceable in a horizontal plane.

The ship's waterline plane is indicated on the drawing by the line VL. Loading of the stabilized vessel will be reduced relative to the summer load line. Increased freeboard is advantageous in order to reduce water on deck under heavy weather loads.

The depth positioning of the stabilizer platforms is selected according to the wave energy at any given time and is determined by trails, calculations and experience. A suggested favourable depth would be down to 10 m beneath the bottom of the ship, when the draught of the ship is 8 m, where the significant wave height as given by a Jonswarp spectrum is 5 m and the spectrum peak is 8.7 seconds. The ship's length and breadth are chosen to be 200 and 30 m, respectively. When the stabilizer platforms are lowered to a depth of 18 m below the surface of the sea, the wave energy will be reduced to approximately 5% of its surface energy.

Two stabilizer platforms are shown on FIG. 1. Only one platform could of course be utilized, or more than two, depending on the requirements.

Figure 2:
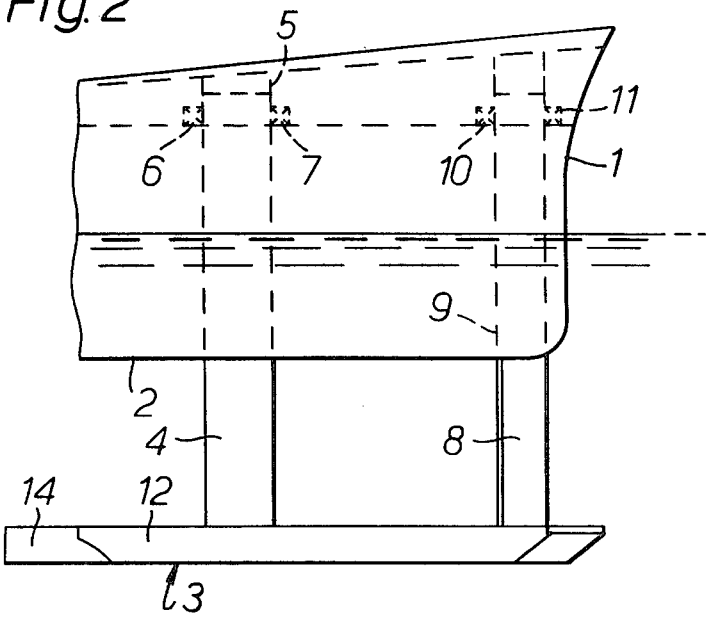
FIG. 2 is a schematic side view of the forward section of a surface vessel carrying a stabilizer body in the lowered, working position.

A surface vessel 1 is shown on FIG. 2. The figure shows the forepart of the vessel. At a distance beneath the bottom 2 of the vessel, a stabilizer body 3 is positioned. A column 4 travels in a vertical shaft 5 through the ship and is connected at the bottom to the stabilizers 3. On the ship, the column 4 is connected to hydraulic jacks 6 and 7 which permit the column 4 to be raised and lowered in the shaft 5. A forward column 8 is similarly connected at the bottom to the stabilizer body 3, and goes through the ship in a shaft 9. The column 8 can also be raised and lowered in its shaft by means of hydraulic jacks 10 and 11.

The stabilizer body is constructed of three main parts, two platform-shaped sections 12 and 13 and a central support member 14. The support member 14 is connected to the two columns 4 and 8, and the two platform sections 12 and 13 are supported so as to be movable along the central support member 14 in a manner to be explained more fully below.

Figure 3:
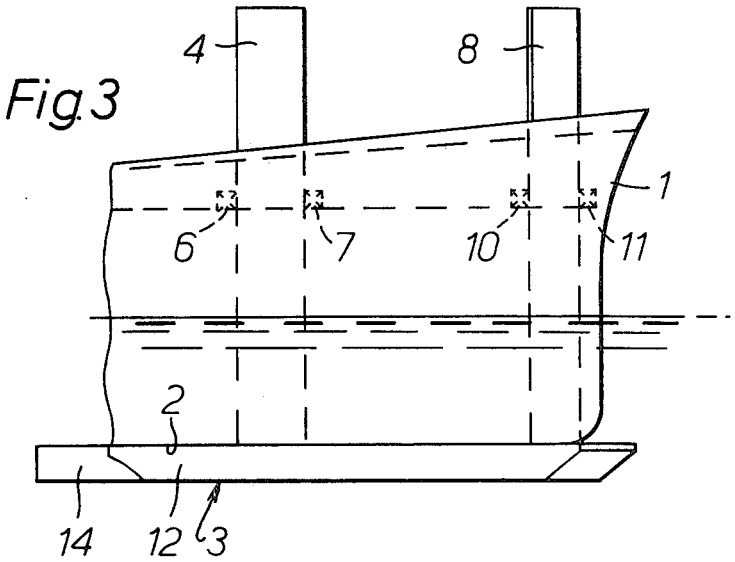
FIG. 3 shows the ship of FIG. 2 with the stabilizer body retracted up against the bottom of the ship.
Figure 4:
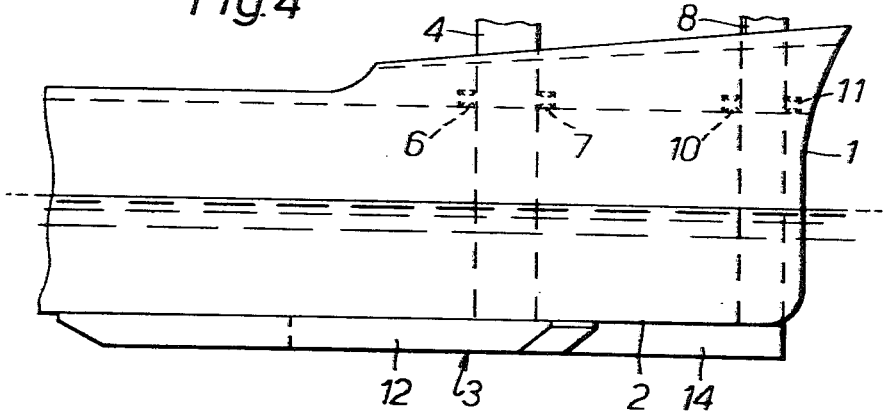
FIG. 4 shows the ship of FIGS. 2 and 3 with the stabilizer body moved back into a transport position beneath and completely within the area of the bottom of the ship.
Figure 7:
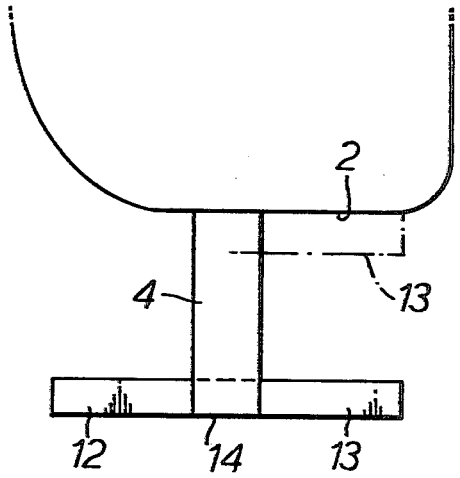
FIG. 7 shows the stabilizer means of FIG. 2, seen from the front, in a schematic cross section at the rear column.
Figure 8:
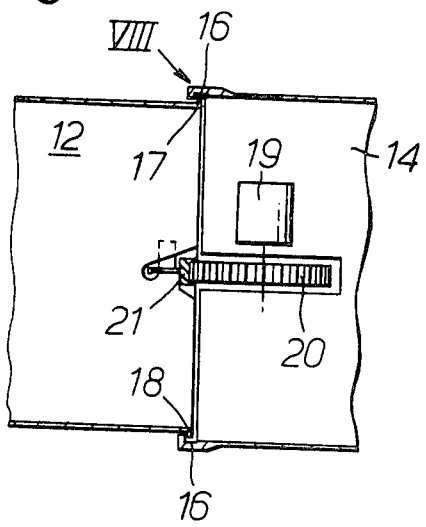
FIG. 8 shows a schematic cross section on a larger scale along line VII—VII of FIG. 6.

By means of the hydraulic jacks 6, 7 and 10, 11, the columns 4 and 8 can be raised and lowered, and the stabilizer body can thus be brought into the position shown on FIG. 3. In this position, the platforms 12 and 13 will project out beyond the bottom surface of the ship. However, because the platforms 12 and 13 are supported so as to be movable along the support member 14, the platforms can be moved back to the position shown on FIGS. 4 and 6. In this position, the platforms 12 and 13 lie up against the bottom of the ship and within the area of the ship's bottom. This is also shown in the right-hand section of FIG. 7, where the dashed lines indicate the position of the port side platform 13 beneath the bottom 2 of the ship. FIG. 8 shows, purely schematically, how the central support member 14 has undercut guide rails 15, 16. These cooperate with corresponding guide sections 17, 18 on, in this case, platform section 12. The support member 14 has a reversible hydraulic motor 19 which drives a pinion 20. The hydraulic motor 19 can preferably be locked into a desired position. The pinion 20 meshes with a rack 21 on the platform 12. By operating the motor 19, therefore, one can move the platform 12 along the support member 14.

Figure 9:
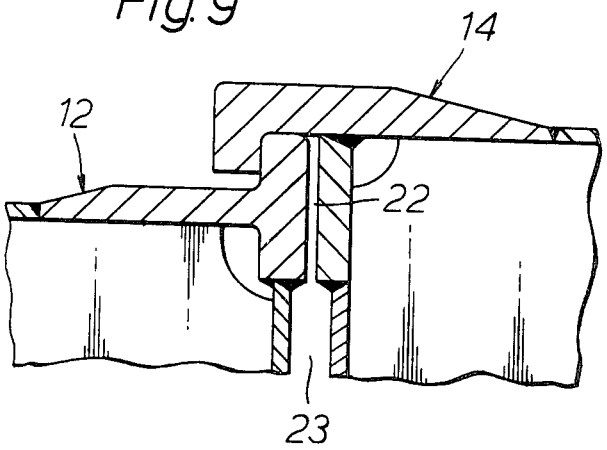
FIG. 9 is an enlarged detail section of the area marked with the arrow VIII—VIII on FIG. 8.

Further details of the control and support of the platform parts on the support member are shown on FIG. 9, which shows on an enlarged scale one possible embodiment of the control and support. In the space 22 between the platform 12 and the support member 14, a lubricant is preferably injected. In the space 23, sea water is preferably injected, e.g. at a pressure corresponding to 5 kp/cm$^2$. This provides simple and robust support, control and attachment.

Advantageously, the platform sections 12 and 13, and possible also the columns 4 and 8, can be provided with ballast. Further arrangements for this are not shown, as these techniques are known per se. It is preferable that the platform sections 12 and 13 have permanent ballast.

Figure 5:
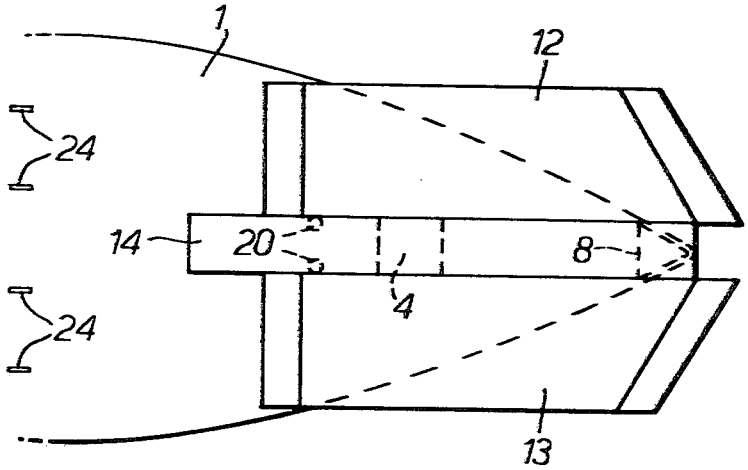
FIG. 5 shows, purely schematically, the foreship section of FIGS. 2 and 3 seen from below.
Figure 6:
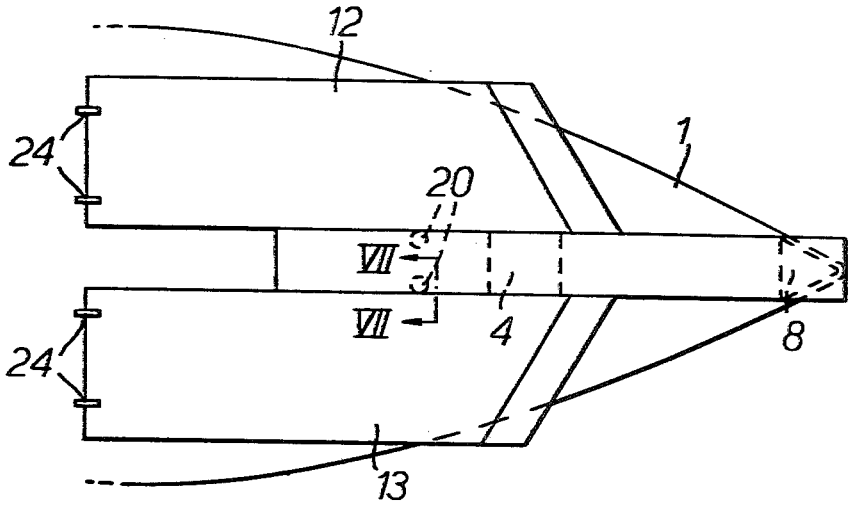
FIG. 6 shows the foreship section of FIG. 4 seen from below.

On FIGS. 5 and 6, locking mechanisms 24 are indicated on the bottom of the ship for locking and retaining the platform sections 12 and 13 in the rear transport position. Further details are not shown, as this also comprises known per se technology.

As evident from the embodiment illustrated and described above, when the stabilizer is in the transport position, it assumes a less vulnerable position beneath the flat bottom of the ship. This is also of significance with regard to the ship's propulsion resistance. It has been found that better stabilization, especially forward, can be obtained of the stabilizer body is arranged such that it extends out beyond the vessel's waterline plane. However, this means that when the stabilizer platform is retracted into the transport position, it will project out beyond the bottom of the ship and thus constitute a projection which is affected by the sea. When the ship is moving, therefore, the stabilizer body can be subjected to very large forces, and it is uneconomical to dimension the stabilizer structure to correspond to these. In addition, when the stabilizer body is in the retracted position, it will significantly increase the ship's propulsion resistance and negatively affect the ship's behaviour in the sea.

This disadvantage is eliminated in that the stabilizer body can be moved astern in the ship's longitudinal direction and brought into a transport position in which the stabilizer body lies completely within the area of the bottom of the ship.

One thus obtains a combination of two advantages, namely, the stabilizer body in the working position projects out beyond the waterline plane, while in the transport position it lies snugly against and within the area of the ship's bottom.

Having described my invention, I claim:

1. A self-propelled surface ship adapted for work in off-shore locations, and having two perpendiculars, one fore and one aft; the perpendiculars being separated by a distance L, and having a midpoint therebetween; the ship also having stabilizing apparatus comprising:

(a) a forward stabilizer body having a horizontal surface area in the range of from 13% to 20% of the ship's waterplane area, with its center of gravity located forward of the midpoint a distance of at least 0.22 L when in an operative position;

(b) an aft stabilizer body having a horizontal surface area of from 7% to 15% of the ship's waterplane area, with its center of gravity located aft of the midpoint a distance of at least 0.14 L when in an operative position; and (c) means for raising and retracting said stabilizer bodies to respective transport positions so that they lie snugly against the ship's bottom and will not interfere with its movement, and for returning said stabilizer bodies to their respective operative positions.

2. The ship as claimed in claim 1, wherein the forward stabilizer body has its center at a distance in the range of from 0.22 L to 0.42 L forward of said midpoint.

3. The ship as claimed in claim 1, wherein the aft stabilizer body has its center of gravity at a distance in the range of from 0.14 L to 0.30 L astern of said midpoint.

4. The ship as claimed in claim 1, wherein at least one of the stabilizer bodies is supported so as to be movable in the longitudinal direction of the ship and at least one longitudinal support member is carried by the ship along which member said stabilizer body can be moved in the longitudinal direction of the ship.

5. The ship as claimed in claim 1, wherein the depth of at least one of the stabilizer bodies is established in accordance with the prevailing weather conditions, the ship's orientation relative to the waves, and with respect to the portions of the ship or the movements and acceleration to which one wishes to apply maximum restraint.

6. The ship as claimed in claim 1, wherein each stabilizer body is constructed of two platform-shaped sections and a central support member, the two platform-shaped sections are movable along the support member into a retracted position in which they lie against the vessel's bottom.

7. The ship as claimed in claim 6, wherein the central support member has undercut guide rails cooperating with the platform sections and locking mechanisms for retaining the platform sections in their respective retracted positions.

8. A method for operating a self-propelled surface ship adapted for work in off-shore locations and having two perpendiculars separated by a distance L, and having a midpoint therebetween; the method comprising the steps of:

moving the ship to a desired location at an off-shore workplace; and deploying two stabilizer bodies into respective operative positions, one fore and one aft, the forward stabilizer body having a horizontal surface area in the range of from 13% to 20% of the ship's waterplane area, with its center of gravity located forward of the midpoint of the ship a distance of at least 0.22 L when in its operative position, and the aft stabilizer body having a horizontal surface area of from 7% to 15% of the ship's waterplane area, with its center of gravity located aft of the midpoint a distance at least 0.14 L when in its operative position.

9. A method in accordance with claim 8 further comprising the steps of:

retracting said stabilizer bodies to respective transport positions so that they lie snugly against the bottom of the ship and do not interfere with its movement; and moving said ship to another location.

* * * * *